US007207194B2

(12) United States Patent
Miyamoto

(10) Patent No.: US 7,207,194 B2
(45) Date of Patent: Apr. 24, 2007

(54) WEFT KNITTING MACHINE WITH MOVABLE YARN GUIDE MEMBER

(75) Inventor: Masaki Miyamoto, Wakayama (JP)

(73) Assignee: Shima Seiki, Mfg., Ltd., Wakayama (JP)

( * ) Notice: Subject to any disclaimer, the term of this patent is extended or adjusted under 35 U.S.C. 154(b) by 0 days.

(21) Appl. No.: 10/569,264

(22) PCT Filed: Aug. 24, 2004

(86) PCT No.: PCT/JP2004/012097

§ 371 (c)(1),
(2), (4) Date: Feb. 23, 2006

(87) PCT Pub. No.: WO2005/024106

PCT Pub. Date: Mar. 17, 2005

(65) Prior Publication Data

US 2006/0260365 A1 Nov. 23, 2006

(30) Foreign Application Priority Data

Sep. 2, 2003 (JP) ..... 2003-309765

(51) Int. Cl.
*D04B 15/36* (2006.01)

(52) U.S. Cl. ..... 66/78

(58) Field of Classification Search ..... 66/64, 66/104, 106, 60 H, 61, 78
See application file for complete search history.

(56) References Cited

U.S. PATENT DOCUMENTS

| | | | | |
|---|---|---|---|---|
| 5,063,755 | A * | 11/1991 | Shima et al. | 66/90 |
| 5,280,712 | A | 1/1994 | Nakamori et al. | |
| 5,475,990 | A * | 12/1995 | Schmid et al. | 66/78 |
| 5,884,505 | A | 3/1999 | Shima | |
| 7,059,157 | B2 * | 6/2006 | Morita et al. | 66/90 |

FOREIGN PATENT DOCUMENTS

| | | |
|---|---|---|
| JP | 6-72347 | 9/1994 |
| JP | 3044373 | 5/2000 |
| JP | 3201904 | 8/2001 |

* cited by examiner

*Primary Examiner*—Danny Worrell
(74) *Attorney, Agent, or Firm*—Wenderoth, Lind & Ponack, L.L.P.

(57) ABSTRACT

A stitch cam for setting the density of a knit by drawing in a knitting needle holding yarn fed from a yarn feeder is adjustably provided on a carriage. The stitch cam and the yarn guide member are connected by a linking device such that when the stitch cam moves to a knit-forming side, the movable yarn guide member moves in a direction to advance to a side of a gap portion between the mouth portions, and when the stitch cam moves to a stitch-cam-intermitting side, the movable yarn guide member moves in a direction to be retreated from the gap portion between the mouth portions to a needle bed side.

6 Claims, 6 Drawing Sheets

WEFT KNITTING MACHINE WITH MOVABLE YARN GUIDE MEMBER

TECHNICAL FIELD

The present invention relates to a weft knitting machine having a yarn guide member, and more specifically to a weft knitting machine having a movable yarn guide member whose advancing and retreating operation for the yarn guide member is enabled.

BACKGROUND ART

A weft knitting machine provided with a yarn guide member for guiding yarn to a predetermined lower position so that the yarn fed from a yarn feeder is securely hooked by a knitting needle advanced to a gap portion between mouth portions by a knitting cam of a carriage is known. In the weft knitting machine, needle beds are disposed in a backward-and-forward direction in a state of confronting the mouth portion.

However, since the space of the mouth portion where the yarn guide member is provided is narrow, there has been a possibility that a stitch presser interferes with the yarn guide member when the stitch presser is advanced to the gap portion between the mouth portions to press a stitch, for example.

Accordingly, a weft knitting machine in which the yarn guide member is retreated to a needle bed side from the gap portion between the mouth portions by a driving device when the stitch presser advances to the gap portion between the mouth portions, and presses the stitch is known.

Patent Document 1: Japanese Examined Patent Application Publication No. 6-72347

PROBLEMS TO BE SOLVED BY THE INVENTION

A driving device that drives a yarn guide member is configured such that the yarn guide member instantaneously retreats to the needle bed side from the mouth portion linking with an advancing movement of a stitch presser only when the stitch presser advances to a gap portion between mouth portions by a driving motor mounted on a carriage. Accordingly, the yarn guide member staying in a specific zone where the carriage passes by cannot be appropriately kept in a state retreated from the gap portion between the mouth portions to the needle bed side.

Further, as described in Japanese Examined Patent Application Publication No. 6-72347, in the weft knitting machine where the driving motor for operating the yarn guide member via the stitch presser is mounted on the carriage, not only the size of the carriage increases but also mass increases as well. Further, since inertia caused by the carriage driven for a reciprocating movement increases, a driving device having high power is required. A problem occurs, in which the thus constructed weft knitting machine does not suit the knitting machines that repeat frequent reciprocating movement at high speed for producing knitting products, such as a glove, socks, or the like, having small knitting width.

Furthermore, it is emphasized not only to produce the aforementioned knitting products, such as the glove, the socks, or the like, but also to produce a product to be as close to a complete product as possible on the knitting machine, resulting in work saving for the post-process. Accordingly, it becomes hard to secure space for appropriately disposing members to automatically catch and cut unused end yarn produced at the beginning of and/or end of knitting fingertips, or switching the yarn, and inserting the unused end yarn into the knit, or for appropriately disposing assistant members of knitting for the work saving, other than the above.

The present invention is proposed in light of the above described problems, and an object of the present invention is to keep a state in which the yarn guide member is retreating from the gap portion between the mouth portions by a simple structure without constructing the carriage to be large sized.

SUMMARY OF THE INVENTION

To achieve the above-described object, a weft knitting machine having a movable yarn guide member of the present invention is mainly characterized in that in the movable yarn guide member, a needle plate is disposed on a needle bed at an even interval. The needle bed is disposed side by side between each of the needle plates for a knitting needle to be able to be operated for advancing and retreating by a carriage, and the needle beds are disposed in a backward-and-forward direction in a state of confronting the mouth portion thereof. The carriage for sliding the knitting needle to advance and retreat is provided to be able to run on each of the needle beds. The yarn guide member for guiding yarn fed from a yarn feeder to a predetermined position is provided to be able to advance and retreat in the mouth portion, and a stitch cam for setting a density of a knit by drawing in a knitting needle holding the yarn fed from the yarn feeder is provided in the carriage in a manner so as to be able to adjust the density of the knit. The stitch cam and the yarn guide member are connected by a linking device in a manner such that when the stitch cam moves to a knit-forming side for forming the knit, the movable yarn guide member moves in a direction to advance to a side of a gap portion between the mouth portions, and when the stitch cam moves to a stitch-cam-intermitting side where the knit is not formed, the movable yarn guide member moves in a direction to be retreated from the gap portion between the mouth portions to a needle bed side.

Further, the weft knitting machine having a movable yarn guide member in the present invention is characterized in that either one of a pair of left and right stitch cams provided on the carriage and a yarn guide member are connected to each other by the linking device. The linking device includes a groove cam formed on the stitch cam, an operating bellcrank operated for a swinging movement by engaging one end thereof with the groove cam, a swinging arm whose one end is connected to the other end of the operating bellcrank, and a middle portion thereof which is pivotably supported by a rotation shaft. A yarn guide member control cam is operable to raise and lower the other end of the swinging arm. Alternatively, the stitch cam is configured to be able to be raised and lowered by a driving device provided at a portion out of the carriage.

ADVANTAGES

A weft knitting machine having a movable yarn guide member of the present invention is configured such that a stitch cam for setting a density of a knit by drawing in a knitting needle holding the yarn fed from the yarn feeder is provided in the carriage in a manner so as to be able to adjust the density of the knit. The stitch cam and the yarn guide member are connected by a linking device in a manner such that when the stitch cam moves to a knit-forming side for forming the knit, the movable yarn guide member moves in a direction to advance to a side of a gap portion between the mouth portions, and when the stitch cam moves to a stitch-cam-intermitting side, or a value of the density of the knit is zero, where the knit is not formed, the movable yarn guide member moves in a direction to be retreated from the gap portion between the mouth portions to a needle bed side.

Accordingly, at a time of knitting for forming the knit by adjusting the density of the knit by means of the stitch cam, the yarn guide member can be advanced to the gap portion between the mouth portions. On the other hand, at the stitch-cam-intermitting side where the knit is not formed by the stitch cam, namely when the stitch cam is moved to a state that the knit is not drawn in, the yarn guide member can be retreated from the gap portion between the mouth portions to the needle bed side and can be held in the state. Thereby, space for appropriately disposing a knitting work assisting member for automatically inserting unused end yarn produced at the beginning of and the end of knitting into the knit can be secured.

DETAILED DESCRIPTION OF THE INVENTION

Figure 1:
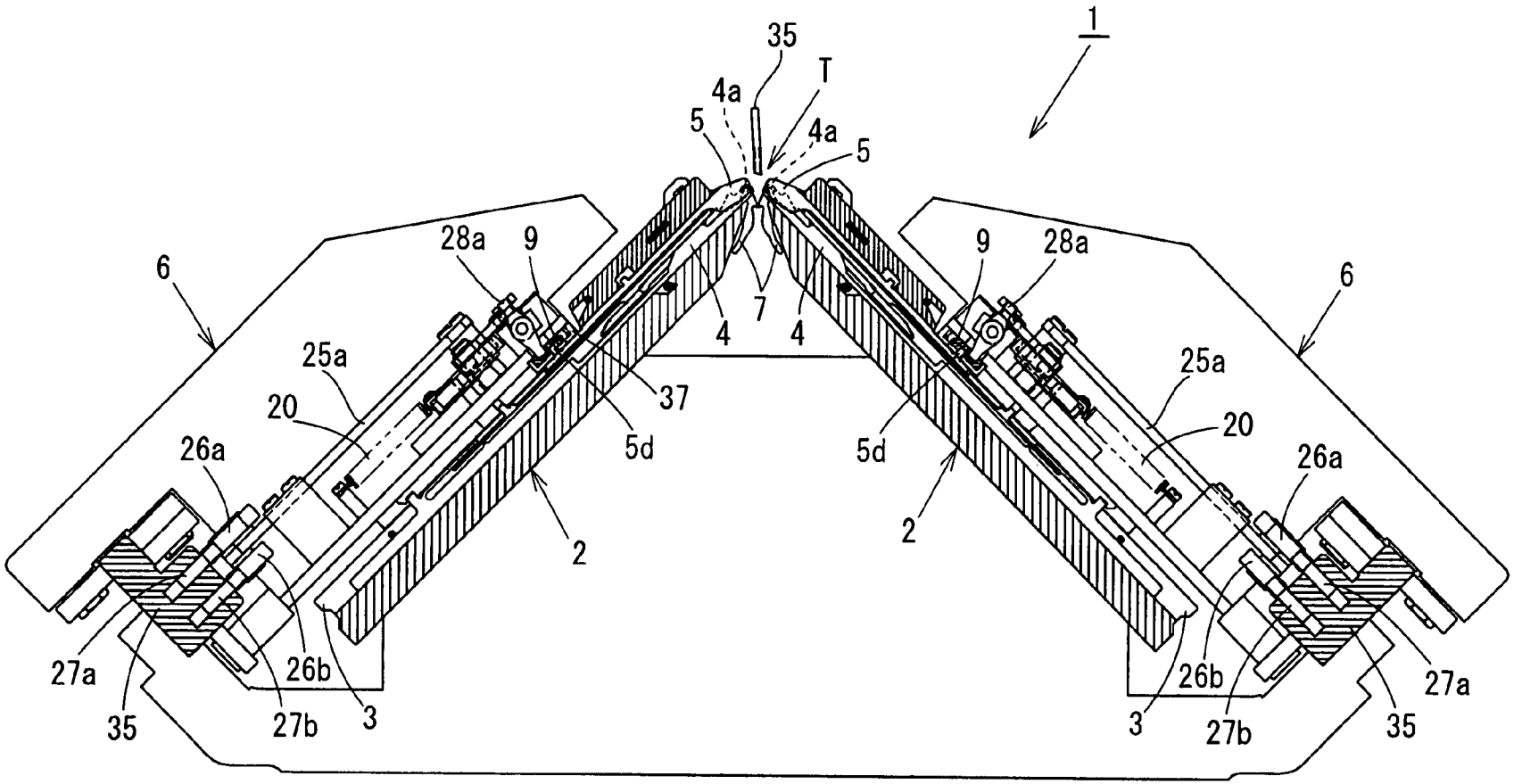
FIG. 1 is a side elevation showing a schematic construction of a mouth portion of a weft knitting machine (first embodiment)

The left and right stitch cams mounted on the carriage are configured to be individually operable for rising and lowering by a driving device mounted on the carriage. Either one of the left and right stitch cams is connected to the yarn guide member by a connecting device so that the yarn guide member can be advanced or retreated in accordance with a position of either one of the left and right stitch cams. Since the stitch cam is set to a sliding direction of the carriage to either a precedent side (a side at which the knit is not formed) or a succeeding side (a side at which the knit is formed) at a time of knitting, the space is effectively utilized. Accordingly, smaller and lighter carriages can be realized.

First Embodiment

Hereinbelow, a weft knitting machine having a movable yarn guide member with respect to a first embodiment of the present invention will be explained while referring to the drawings.

FIG. 1 is a side elevation showing a schematic construction of a mouth portion of the weft knitting machine. Number 1, in FIG. 1, denotes an entire structure of the weft knitting machine. The weft knitting machine 1 is provided with a carriage 6, shown in FIG. 2, at an upper part of the needle bed 2. Needle plates 3 are disposed on the needle bed 2 at even intervals.

A plurality of knitting needles 4 of a compound needle-type and yarn guide members 5 are respectively disposed side by side between the needle plates, 3 and 3, in a manner so as to be able to operate for advancing and retreating. A pair of the needle beds 2 is configured so that the needle beds face each other in a manner such that the mouth portion of each of the knitting needles 4 comes close together in an upside-down-V like form as shown in the side elevation in FIG. 1.

At a tip end portion of the needle bed 2, a movable sinker 7 operated for swinging by the carriage 6 is disposed. A gap portion T between the mouth portions is formed between each of the mouth portions of the needle plates, 3 and 3. A knitting needle 4 and the yarn guide member 5 of both of the needle beds 2 are configured to be operated for advancing and retreating by a cam group or the like in the carriage 6.

Figure 2:
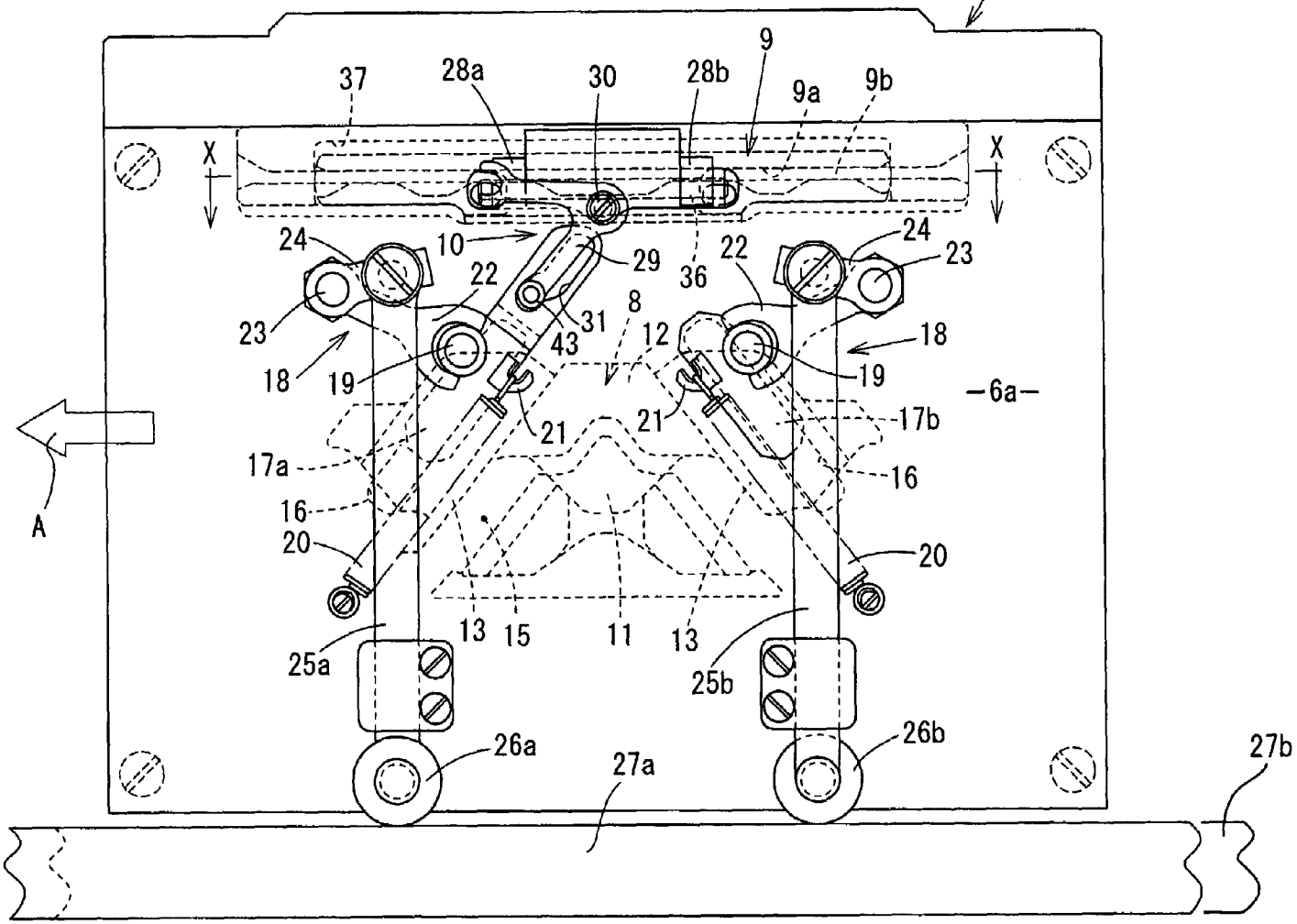
FIG. 2 is a plan view showing a schematic construction of a portion of a cam group of a carriage (first embodiment)

FIG. 2 is a development elevation schematically showing the cam group mounted on the carriage 6 so as to knit the knit by advancing and retreating the knitting needle 4 of the needle bed 2. In FIG. 2, a numeral 8 denotes a knitting cam, and a numeral 9 denotes a yarn guide member control cam that controls the advancing and retreating movement of the yarn guide member 5. In addition, a numeral 10 denotes a linking device for linking the yarn guide member control cam 9 with a movement of a stitch cam 13, described later.

The yarn guide member 5 is a member whose tip end portion is positioned in the vicinity of a tip end of a hook 4*a* of the knitting needle 4. A guide face 5*b* for guiding the yarn to a predetermined position when the yarn guide member 5 is advanced to the gap portion T between the mouth portions is formed at a lower face of a tip end of the yarn guide member. A bat 5*d* that hooks with a groove cam 9*a* of the yarn guide member control cam 9 is formed on an operation rod 5*c* extending toward a side of the cam group of the carriage 6 (Refer to FIG. 3).

A knitting cam 8 is provided with a needle raising cam 11 having an angular shape, a guard cam 12 disposed on a center of an upper part of the needle raising cam 11, and the stitch cams, 13 and 13, slidably provided at both sides of the guard cam 12 along a side face thereof. A cam orbit 15 where a bat 14 of the knitting needle 4 passes through is constructed between the needle raising cam 11 and the guard cam 12, and between the stitch cam, 13 and 13 (Refer to FIG. 2).

Each of sliding holes 16 are pierced in a cam plate 6*a* of the carriage 6 in an upside-down-V like form, as shown in the side elevation in FIG. 2, and respective sliding members, 17*a* and 17*b*, are slidably fitted into each of the sliding holes, 16 and 16. Further, both the stitch cams 13 are attached to a rear face side (needle bed side) of the sliding members, 17*a* and 17*b*.

Furthermore, a pin 19 to which a link 18 for setting the density of the knit, described later, is connected is implanted at a surface side portion (inner side of the carriage) of the sliding members, 17*a* and 17*b*. One end of a spring 20 for pulling down the stitch cam is connected to a cam plate 6*a* of the carriage 6, and the other end of the spring 20 is connected to the hook 21. The hook 21 is provided at a surface side portion of the sliding members, 17*a* and 17*b*. In addition, the stitch cam 13 is always kept under tension in a manner so as to be dragged downward by the tension of the spring 20.

Further, the carriage 6, shown in FIG. 2, is configured to slide from the right side to the left side in a direction indicated by an arrow A. The stitch cam 13 at the left side is the stitch cam 13 of a precedent side.

The link 18 for setting the density of the knit operates each of the stitch cams 13 for raising and lowering, namely adjusts the density of the knit. The link 18 for setting the density of the knit is provided with an operation arm 22, tip end of which is fitted into the aforementioned pin 19, a swinging arm 24 that shares a supporting shaft 23 of the operation arm 22, and raising and lowering rods, 25*a* and 25*b*, connected to a tip end of the swinging arm 24. Both the left and right raising and lowering rods, 25*a* and 25*b*, are configured such that rollers, 26*a* and 26*b*, attached to a lower end portion thereof are pressed up by two plates, 27*a* and 27*b*, for controlling the stitch cam, which are provided to a guide rail 35 (Refer to FIG. 1).

Accordingly, the plates, 27*a* and 27*b*, for controlling the stitch cams are configured to be able to individually operate the left and right raising and lowering rods, 25*a* and 25*b*.

Incidentally, although a moving and operating device of the plate 27 for controlling the stitch cam is not shown, for example, the moving and operating device having a structure described in the Japanese Unexamined Patent Application Publication No. 3-185161 is used.

In other words, a stepping motor driven for rotation by a signal generated from a control device of a weft knitting machine is provided at an end portion of a needle bed, and a spiral groove cam is attached to a rotation shaft of the stepping motor. In addition, an end portion of the plate 27 for controlling the stitch cam is engaged with the spiral groove cam, and a slanting elongated hole is pierced in the plates, 27*a* and 27*b*, for controlling the stitch cam. Further, a pin provided in the guide rail 35 is fit into the elongated hole. Thereby the plates, 27*a* and 27*b*, for controlling the stitch cam are moved in a left and right direction. As a result, the height of the plates, 27*a* and 27*b*, for controlling the stitch cam is configured to be varied.

The yarn guide member control cam 9 is configured to rise and lower in upper and lower directions by being guided by a yarn guide member guide cam 37 fixed to a rear face side (needle bed side) of the cam plate 6*a*, and the cam plate 6*a*. Further, the groove cam 9*a* being engaged with a bat 5*a* of the yarn guide 5 is provided at a face of the needle bed side, and two fitting grooves 9*b* being engaged with a linking device 10, described later, are provided at a face of the cam plate 6*a* side being spaced apart at a predetermined interval in a longitudinal direction.

Figure 3:
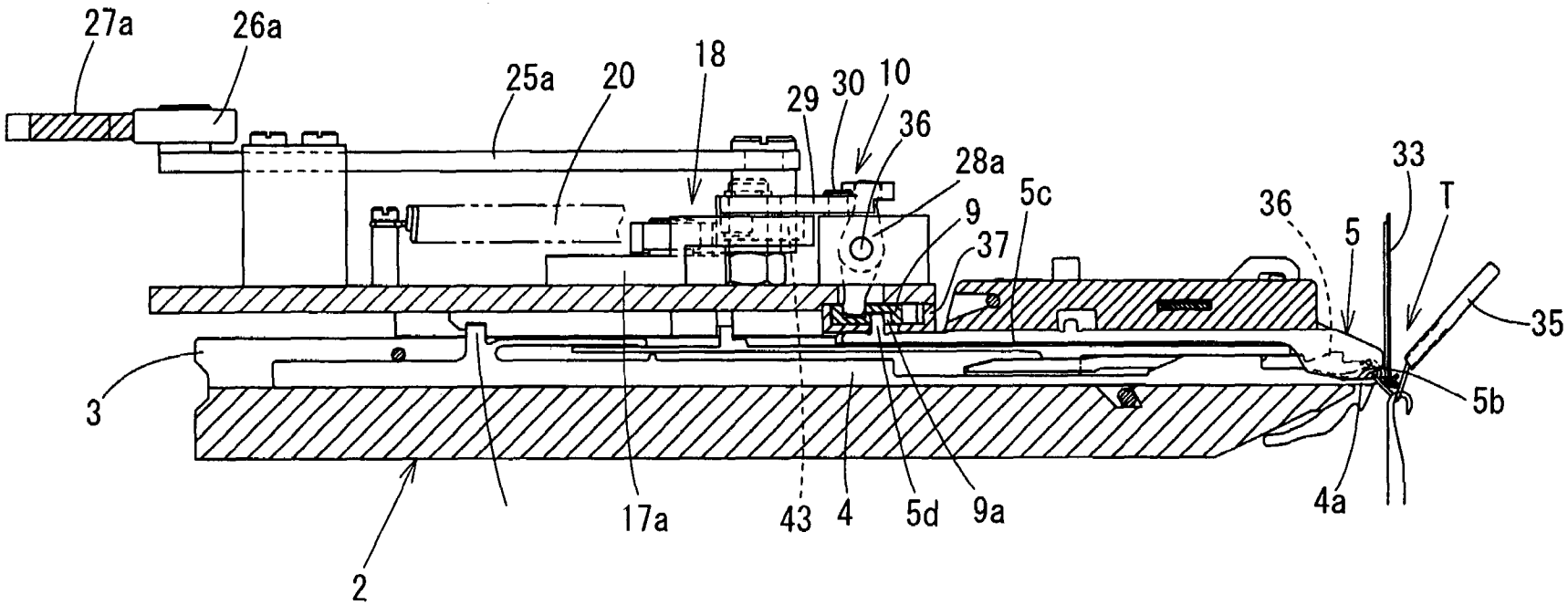
FIG. 3 is a side elevation showing a schematic construction of a portion of a linking device of a stitch cam and a yarn guide member (first embodiment)
Figure 4:
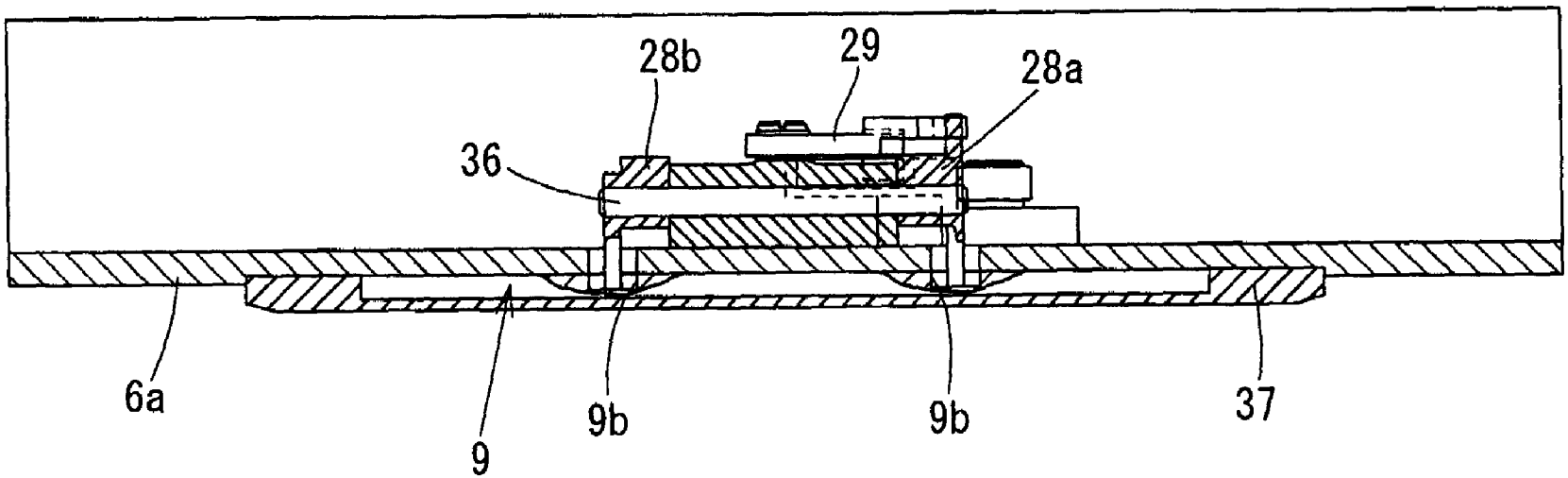
FIG. 4 is a cross-section along a line X—X of FIG. 2 (first embodiment)

On the other hand, the linking device 10 for linking the yarn guide member control cam 9 with a movement of the stitch cam 13 is composed of swinging arms, 28*a* and 28*b*, for operating the yarn guide member control cam 9 for providing raising and lowering movement, in which the groove cam 9*a* is formed, an L-shaped operating bellcrank 29 for swinging the swing arm 28*a* by linking the precedent stitch cam 13, and a cam groove 31 for linking the L-shaped operating bellcrank 29 with one of (left side in the figure) the stitch cams 13, which is formed in a sliding member 17*a*, as shown in FIGS. 2 through 4.

A middle portion of the aforementioned L-shaped operating bellcrank 29, which is bent over, is defined as a fulcrum 30 of a swinging movement. One end of the aforementioned L-shaped operating bellcrank 29 is engaged with the cam groove 31 formed at an upper part of a surface side of the sliding member 17*a* of the stitch cam 13 via a cam roller 43, and the other end of the same is connected to an upper end portion of a swinging arm 28*a* (Refer to FIGS. 3 and 4).

A middle portion of the swinging arm 28*a* is pivotably supported by a rotation shaft 36 and a lower end portion of the swinging arm 28*a* and a swinging arm 28*b* of the other end side of the rotation shaft 36 are downwardly projected out from a penetrating groove of the cam plate 6*a* of the carriage 6. A tip end portion of the swinging arm 28*a* is fit into a fitting groove 9*b* provided at an upper face of the yarn guide member control cam 9 disposed in a manner so as to be raised and lowered in the upper and lower direction at a rear face of the cam plate 6*a* (needle bed side).

A function of the weft knitting machine having a movable yarn guide member constructed above will be explained hereinbelow.

As indicated by the arrow A in FIG. 2, when a state in which the yarn guide member 5 is retreated from the gap portion between the mouth portions is held in a case when the carriage 6 is sliding from the right to left, a plate 27*a* for controlling the stitch cam (not shown) is set to a predetermined height by a moving operation device preceding the sliding movement of the carriage 6.

When the plate 27*a* for controlling the stitch cam rises, the stitch cam 13 at the left side rises up to an intermitting position of the stitch cam where the knit is not formed via the rollers 26*a*, the raising and lowering rod, 25*a*, and the operation arm 22.

When the stitch cam 13 at a precedent side rises, the operating bellcrank 29 swings along the same in a clockwise direction by means of the cam roller 43 sliding along the cam groove 31 formed at an upper end portion of a surface side of the sliding member 17*a*.

An engaging end of the swinging arm 28*a* with the operating bellcrank 29 swings in an upward direction (mouth portion side) in the figure, around the rotation shaft 36 serving as a fulcrum by means of the swinging movement of the operating bellcrank 29. A tip end of the swinging arm 28*b* swings in a downward direction (opposite to the mouth portion side) in the figure, around the rotation shaft 36 serving as a fulcrum. Consequently, the yarn guide member control cam 9 is operated for moving in the downward direction, namely the direction for leaving from the mouth portion side in the figure.

Accordingly, when the carriage 6 slides on the needle bed 2 in a state in which the yarn guide member control cam 9 is downwardly moved, the bat 5*d* engaging with the groove cam 9*a* of the yarn guide control cam 9 is pulled down. As a result, the yarn guide member 5 is brought to a state to be retreated from the gap portion T between the mouth portions, as shown in FIG. 3 and the gap portion T between the mouth portions is largely opened.

Accordingly, even when a yarn insertion member 33 for treating the unused end yarn produced during the process of knitting performs relative movement to the carriage 6, there is no possibility that the yarn insertion member 33 interferes with the tip end of the yarn guide member 5.

As described above, as for the course of the carriage 6 that retreats the yarn guide member 5 from the gap portion T between the mouth portions to the side of the needle bed 2, two courses can be set. That is, either one of a course in which the knitting is intermitting or a course in which the stitch cam 13 at a side to be connected to the linking device 10 serves as that of a precedent side can be set.

There is no need to provide the linking device 10 in the stitch cam 13 of the other side (posterior side), and the position can be arbitrarily set via a roller 26*b*, the raising and lowering rod 25*b*, the operation arm 22, and a sliding member 17*b*, by a moving device of the plate 27*b* for controlling the stitch cam (not shown).

Figure 5:
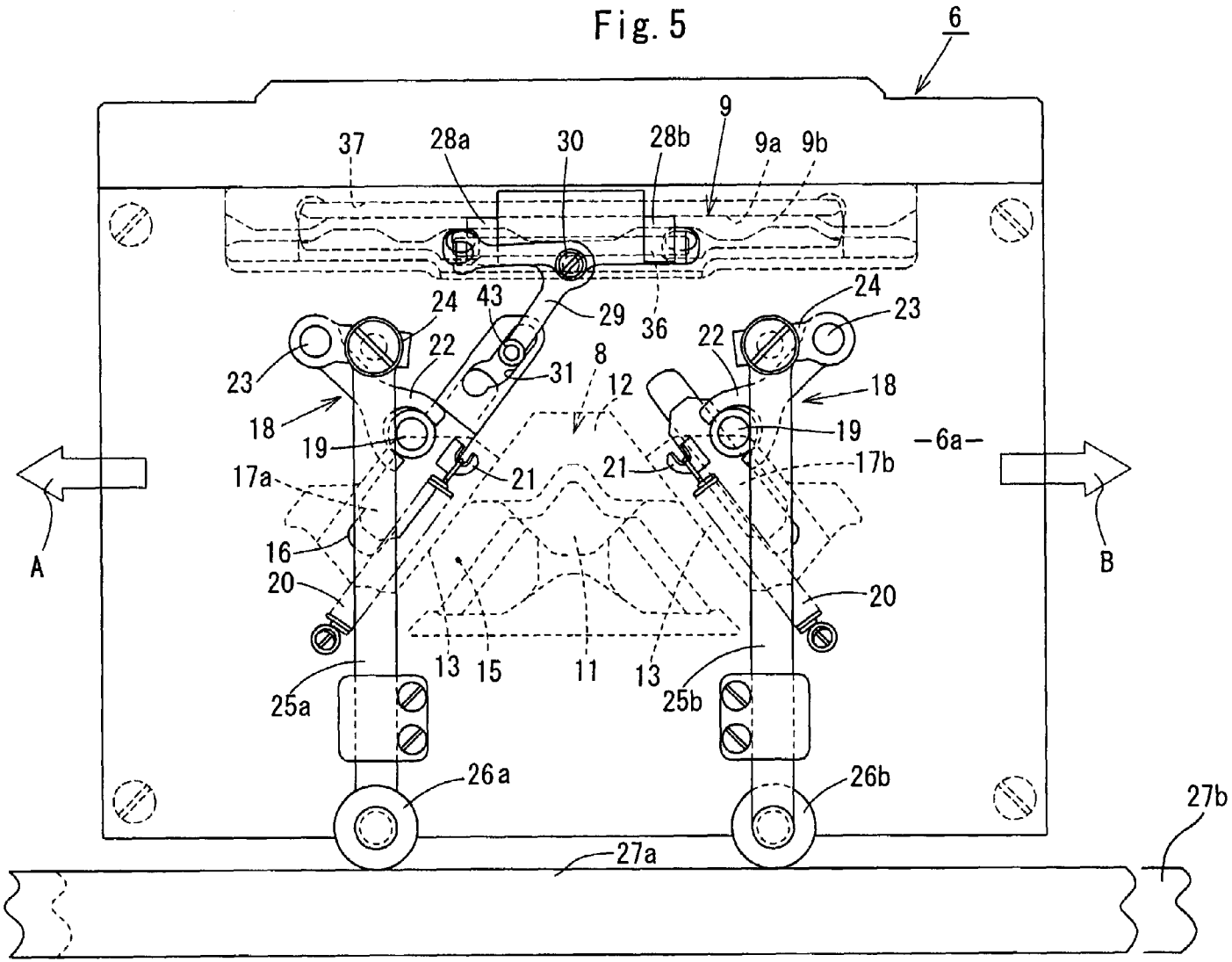
FIG. 5 is a plan view showing a schematic construction of the portion of the cam group when the yarn guide member is advanced to the mouth portion (first embodiment)

Next, as indicated by arrows, A and B, in FIG. 5, in a case when the carriage 6 slides from the right to the left, or from the left to the right, and when both of the stitch cams, 13 and 13, are set to a knitting area, and further, the yarn guide member 5 is advanced to the gap portion T between the mouth portions, the plates, 27*a* and 27*b*, for controlling the stitch cam are moved down from a position, shown in FIG. 2 to a desired position, shown in FIG. 5 by a movement control device for moving the plates, 27*a* and 27*b*, for controlling the stitch cam (not shown).

When the plates, 27*a* and 27*b*, for controlling the stitch cam are moved down, both the stitch cams, 13 and 13, are moved down to a predetermined knit density position via the rollers, 26*a* and 26*b*, the rising and lowering rods, 25*a* and 25*b*, and the operation arm 22.

When the precedent stitch cam 13 is lowered (moved down), the operating bellcrank 29 is rotated in a counter-clockwise direction by the cam roller 43 sliding along the cam groove 31 formed at an upper end portion of a surface side of the sliding member 17*a* with the lowering down movement of the precedent stitch cam 13.

Due to the swinging movement of the operating bellcrank 29, the engaging end of the swinging arm 28*a* with the operating bellcrank 29 swings in a downward direction (opposite to the mouth portion side) in the figure around the rotation shaft 36 as a fulcrum. In addition, tip ends of both of a lower end portion of the swinging arm 28*a* and the swinging arm 28*b* swing in an upward direction (mouth portion side) in the figure around the rotation shaft 36 as a fulcrum. Thereby, the yarn guide member control cam 9 is operated to be moved in an upward direction in the figure, namely in a direction of the mouth portion side.

Figure 6:
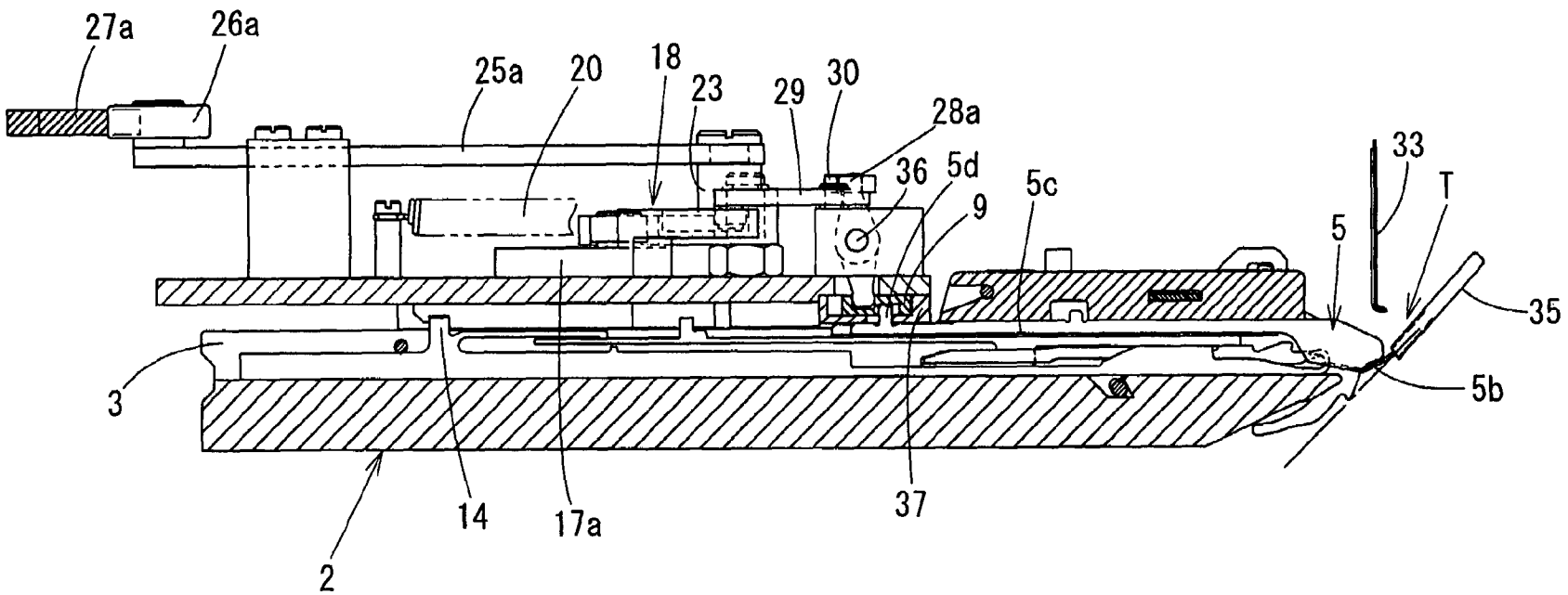
FIG. 6 is a side elevation in a state that the yarn guide member is advanced to the mouth portion (first embodiment).

Thus, when the carriage 6 slides on the needle bed 2 in a state in which the yarn guide member control cam 9 is moved upward, the bat 5*a* engaging with the groove cam 9*a* of the yarn guide member control cam 9 is upwardly pressed. Therefore, the yarn guide member 5 is brought to a state to be projected to the gap portion T between the mouth portions, shown in FIG. 6, from the state, shown in FIG. 3.

Accordingly, since yarn fed from a yarn feeder 35 is guided to the guide face 5*b* of a tip end and further guided to a position in the vicinity of a tip end of the hook 4*a* of a knitting needle, even when the hook 4*a* is closed by a slider that advances just afterward with a lowering movement of the knitting needle, the yarn is securely held by the hook 4*a*. Thereafter, the knitting needle 4 is drawn in a predetermined amount by the stitch cam 13. Thereby, knitting having a predetermined knit density is formed.

As described above, by providing the linking device 10 in the stitch cam 13 of one (left side in the embodiment) of the left and the right knitting cams 8 and utilizing the raising and lowering position of the stitch cam 13, the yarn guide member control cam 9 is operated without providing a specific driving mechanism or a control mechanism, and a control of an advancing and retreating operation for the yarn guide member 5 becomes possible.

In addition, in the explanation described above, the stitch cam 13 at the left side and the yarn guide member control cam 9 are connected by the linking device 10 so that the yarn guide member 5 is operated. However, without being limited to such configurations, it is natural to say that the yarn guide member 5 can be operated by connecting the yarn guide member 13 at the right side and the yarn guide member control cam 9 by the linking device 10.

REFERENCE NUMERALS

1: weft knitting machine
2: needle bed
3: needle plate
4: knitting needle
5: yarn guide member
6: carriage
13: stitch cam
35: yarn feeder
T: gap portion between mouth portions

The invention claimed is:

1. A weft knitting machine comprising:

needle beds having needle plates disposed thereon at even intervals, and having knitting needles disposed side-by-side between each of said needle plates so as to be advanced and retreated by a carriage, said needle beds being arranged in a backward-and-forward direction such that mouth portions thereof confront each other, said carriage being operable to slide said knitting needles so as to advance and retreat said knitting needles, and being operable to run on each of said needle beds;

a movable yarn guide member for guiding yarn fed from a yarn feeder to a predetermined position, said yarn guide member being provided at said mouth portions so as to be able to advance and retreat;

a stitch cam for setting a density of knit by drawing in at least one of said knitting needles holding the yarn fed from said yarn feeder, said stitch cam being provided in said carriage and operable to allow adjustment of the density of the knit; and a linking device for linking said stitch cam to said yarn guide member such that when said stitch cam moves to a knit-forming side for forming the knit, said yarn guide member moves in a direction so as to advance to a side of a gap portion between said mouth portions, and such that when said stitch cam moves to a stitch-cam-intermitting side whereat the knit is not formed, said yarn guide member moves in a direction so as to retreat from the gap portion between said mouth portions toward a needle bed side.

2. The weft knitting machine of claim 1, wherein said stitch cam comprises one of a pair of left and right stitch cams on said carriage, one of said pair of stitch cams and said yarn guide member being connected to each other by said linking device.

3. The weft knitting machine of claim 2, wherein said linking device comprises a groove cam formed on said one of said pair of stitch cams, further comprising:

a bellcrank operable to perform a swinging movement, and having a first end engaged with said groove cam;

a swinging arm having a first end connected to a second end of said bellcrank, and having a middle portion thereof pivotably supported by a rotation shaft, and a yarn guide member control cam operable to raise and lower a second end of said swinging arm.

4. The weft knitting machine of claim 2, wherein said one of said pair of stitch cams is configured to be raised and lowered by a driving device provided at a portion outside said carriage.

5. The weft knitting machine of claim 1, wherein said linking device comprises a groove cam formed on said stitch cam, further comprising:

a bellcrank operable to perform a swinging movement, and having a first end engaged with said groove cam;

a swinging arm having a first end connected to a second end of said bellcrank, and having a middle portion thereof pivotably supported by a rotation shaft, and a yarn guide member control cam operable to raise and lower a second end of said swinging arm.

6. The weft knitting machine of claim 1, wherein said stitch cam is configured to be raised and lowered by a driving device provided at a portion outside said carriage.

* * * * *